US011577526B2

(12) United States Patent
Kuramoto

(10) Patent No.: US 11,577,526 B2
(45) Date of Patent: Feb. 14, 2023

(54) PRINTING DEVICE AND CONTROL METHOD FOR PRINTING DEVICE

(71) Applicant: seiko epson corporation, Tokyo (JP)

(72) Inventor: Hiroyuki Kuramoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/328,113

(22) Filed: May 24, 2021

(65) Prior Publication Data

US 2021/0370686 A1 Dec. 2, 2021

(30) Foreign Application Priority Data

May 27, 2020 (JP) ..... JP2020-092018

(51) Int. Cl.

| | |
|---|---|
| ***B41J 3/36*** | (2006.01) |
| ***B41J 29/393*** | (2006.01) |
| ***B41J 3/01*** | (2006.01) |
| ***B41J 19/20*** | (2006.01) |
| ***B41J 2/21*** | (2006.01) |

(52) U.S. Cl.

CPC . *B41J 3/36* (2013.01); *B41J 3/01* (2013.01); *B41J 19/205* (2013.01); *B41J 29/393* (2013.01); *B41J 2/2142* (2013.01); *B41J 2/2146* (2013.01)

(58) Field of Classification Search

CPC ... B41J 29/38; B41J 29/393; B41J 3/36; B41J 2/01; B41J 2/2146; B41J 3/01; B41J 19/205; B41J 2/2142

See application file for complete search history.

(56) References Cited

U.S. PATENT DOCUMENTS

| | | | | |
|---|---|---|---|---|
| 10,350,881 | B2 * | 7/2019 | Shinohara | B41J 3/36 |
| 2018/0250948 | A1 | 9/2018 | Harada et al. | |

FOREIGN PATENT DOCUMENTS

| | | | |
|---|---|---|---|
| JP | 10016313 A | * | 1/1998 |
| JP | 2018-144337 | | 9/2018 |

* cited by examiner

*Primary Examiner* — Jannelle M Lebron
(74) *Attorney, Agent, or Firm* — Workman Nydegger

(57) ABSTRACT

A printing device printing on a medium while being manually moved in relation to the medium is provided. The printing device includes: a speed detection unit detecting a speed of movement at which the printing device is moved; and a stop control unit stopping the printing when the speed of movement exceeds a threshold.

3 Claims, 11 Drawing Sheets

PRINTING DEVICE AND CONTROL METHOD FOR PRINTING DEVICE

The present application is based on, and claims priority from JP Application Serial Number 2020-092018, filed May 27, 2020, the disclosure of which is hereby incorporated by reference herein in its entirety.

BACKGROUND

1. Technical Field

The present disclosure relates to a printing device and a control method for a printing device.

2. Related Art

According to the related art, a handy mobile printer printing on a medium while being manually moved in relation to the medium is known, as disclosed in JP-A-2018-144337.

The handy mobile printer has a problem in that the print density of a print image drops when the print operation does not catch up with the speed of movement at which the handy mobile printer is manually moved.

SUMMARY

A printing device according to an aspect of the present disclosure prints on a medium while being manually moved in relation to the medium. The printing device includes: a speed detection unit detecting a speed of movement at which the printing device is moved; and a control unit stopping the printing when the speed of movement exceeds a threshold.

A control method for a printing device according to another aspect of the present disclosure is a method for controlling a printing device printing on a medium while being manually moved in relation to the medium. The control method executes: detecting a speed of movement at which the printing device is moved; and stopping the printing when the speed of movement exceeds a threshold.

DESCRIPTION OF EXEMPLARY EMBODIMENTS

An embodiment of a printing device and a control method for a printing device will now be described with reference to the accompanying drawings.

Figure 1:
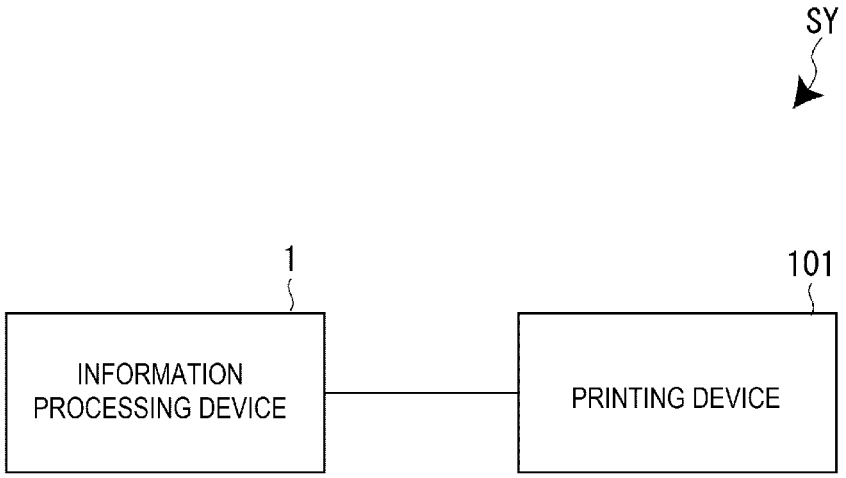
FIG. 1 shows the system configuration of a printing system.

FIG. 1 shows the system configuration of a printing system SY. The printing system SY has an information processing device 1 and a printing device 101. The information processing device 1 and the printing device 101 are coupled in such a way as to be able to communicate via a wire or wirelessly.

The information processing device 1 transmits a print job to the printing device 101. As the information processing device 1, for example, a smartphone, tablet terminal, personal computer or the like can be used.

The printing device 101 prints on a medium 201 (see FIG. 4), based on a print job received from the information processing device 1. The printing device 101 is a so-called handy printer and prints on the medium 201 while being manually moved in relation to the medium 201. The medium 201 is not limited to a print sheet. For example, an envelope, postcard, business card, cardboard, notebook sheet, CD (compact disc) or the like can be used.

Figure 2:
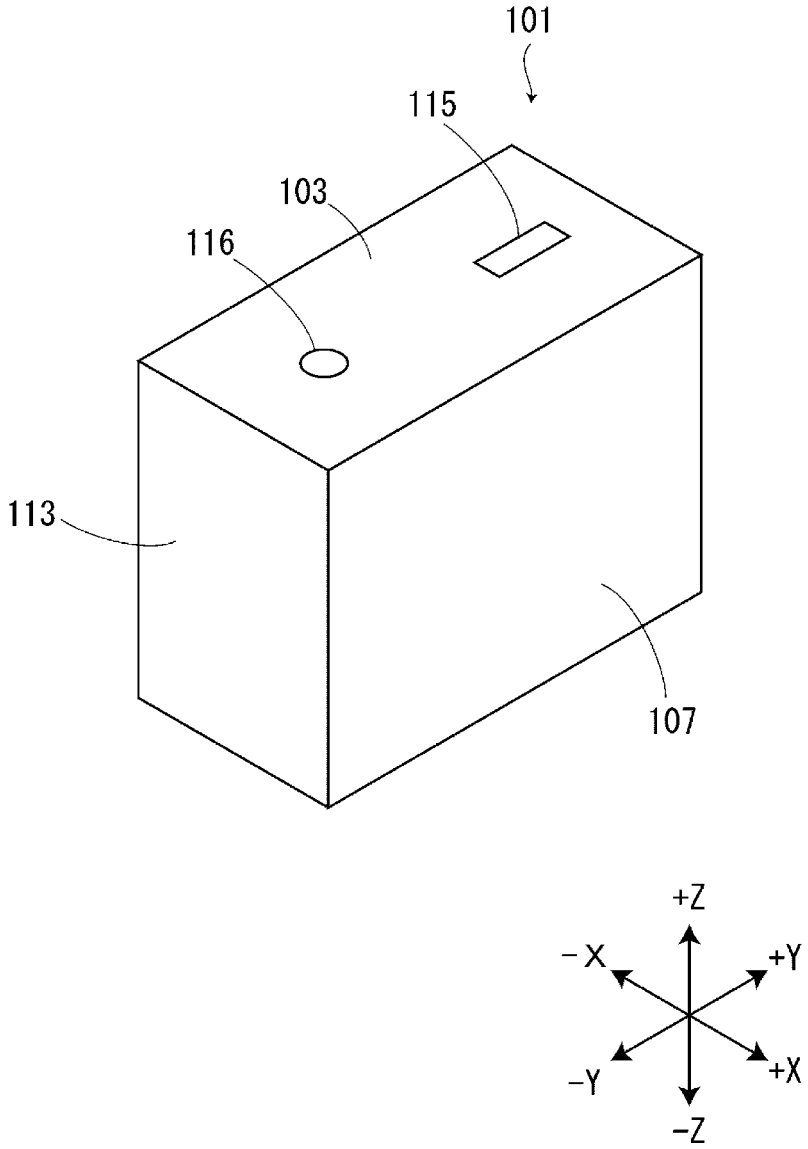
FIG. 2 is an external perspective view of a printing device.

The external configuration of the printing device 101 will now be described with reference to FIGS. 2 and 3. In the description below, a direction as viewed from the printing device 101 is described using a direction in an XYZ coordinate system illustrated in each drawing. However, such directions are solely for the sake of convenience of the description and should not limit the embodiment described below.

The printing device 101 is formed substantially in the shape of a rectangular parallelepiped. Of the six outer surfaces of the printing device 101, an outer surface where a print button 115, described later, is provided is referred to as a first outer surface 103. An outer surface opposite to the first outer surface 103 is referred to as a second outer surface 105. Of the four outer surfaces equivalent to the lateral surfaces when the first outer surface 103 or the second outer surface 105 is defined as the bottom surface, one of the two outer surfaces having a large area is referred to as a third outer surface 107 and the other is referred to as a fourth outer surface 109. Also, of the four outer surfaces equivalent to the lateral surfaces, one of the two outer surfaces having a small area is referred to as a fifth outer surface 111 and the other is referred to as a sixth outer surface 113. That is, the first outer surface 103, the second outer surface 105, the third outer surface 107, the fourth outer surface 109, the fifth outer surface 111, and the sixth outer surface 113 are provided in a +Z-direction, a −Z-direction, a +X-direction, a −X-direction, a +Y-direction, and a −Y-direction, respectively, as viewed from the printing device 101.

At the first outer surface 103 of the printing device 101, the print button 115 and a power button 116 are provided. The print button 115 accepts a print start instruction from a user 301 (see FIG. 4). The print start instruction from the user 301 is given, for example, by a short press on the print button 115. The print button 115 is provided in the +Y-direction in relation to a center part of the first outer surface 103. The user 301 places the printing device 101 on the medium 201, subsequently gives a short press on the print button 115, then moves freehand the printing device 101 held in the hand along the surface of the medium 201, and thus can cause the printing device 101 to print a print image 203 (see FIG. 4).

The power button 116 accepts an instruction to switch on or off the power from the user 301. The power button 116 is provided in the −Y-direction in relation to the center part of the first outer surface 103.

Figure 3:
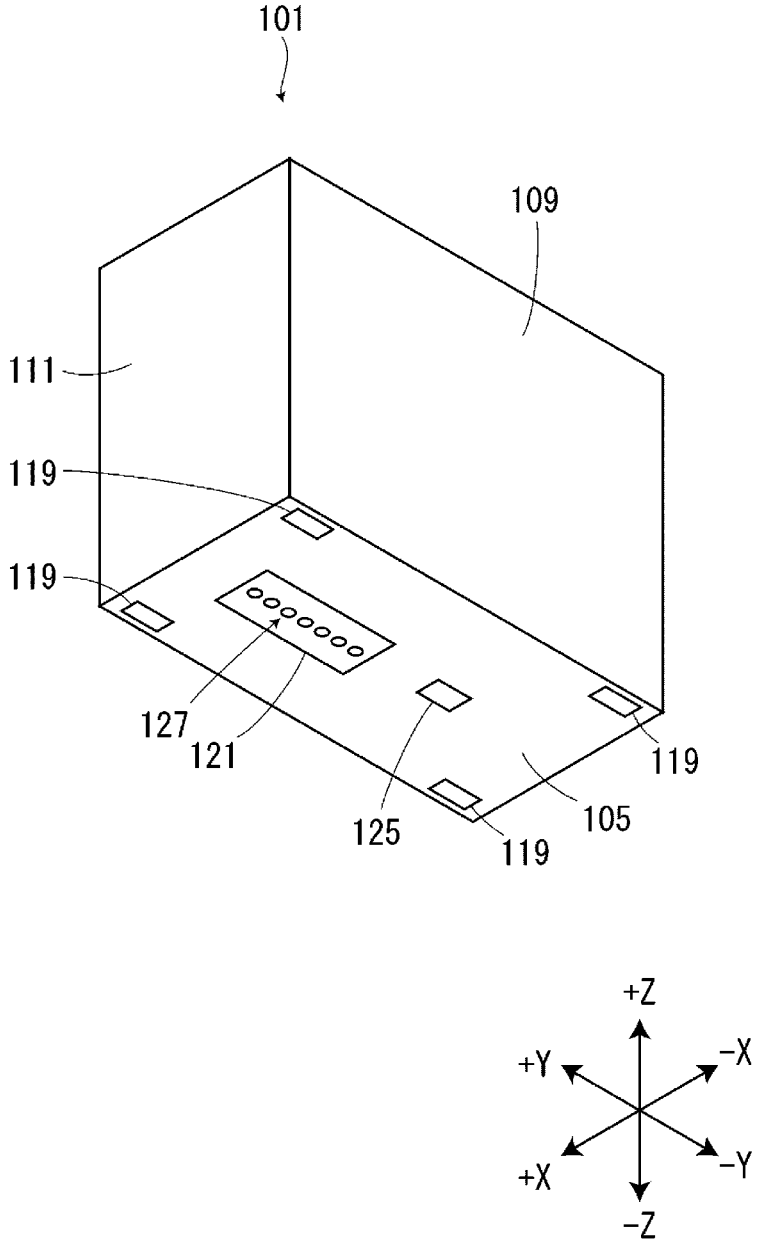
FIG. 3 is an external perspective view of the printing device as viewed from a different angle from FIG. 2.

As shown in FIG. 3, at the second outer surface 105 of the printing device 101, a plurality of rollers 119, a print head 121, and a movement detection sensor 125 are provided.

The plurality of rollers 119 slide and rotate in contact with the medium 201 and thus guide the movement of the printing device 101 in the X-direction in relation to the medium 201.

The print head 121 is an inkjet head having a nozzle array 127 including a plurality of nozzles that are arrayed. The print head 121 ejects ink from each nozzle and thus prints the print image 203 on the medium 201. The print head 121 is provided in the +Y-direction in relation to a center part of the second outer surface 105. That is, the print head 121 is provided in the −Z-direction in relation to the print button 115. The nozzles of the nozzle array 127 are arrayed in the Y-direction.

The movement detection sensor 125 optically scans very small recesses and protrusions on the medium 201 while the printing device 101 is moved in relation to the medium. 201, and thus outputs a movement detection signal. The printing device 101 detects an amount of movement, a direction of movement, and a speed of movement in the X-direction and the Y-direction, based on the movement detection signal outputted from the movement detection sensor 125. The movement detection sensor 125 is provided in the −Y-direction in relation to the print head 121.

Figure 4:
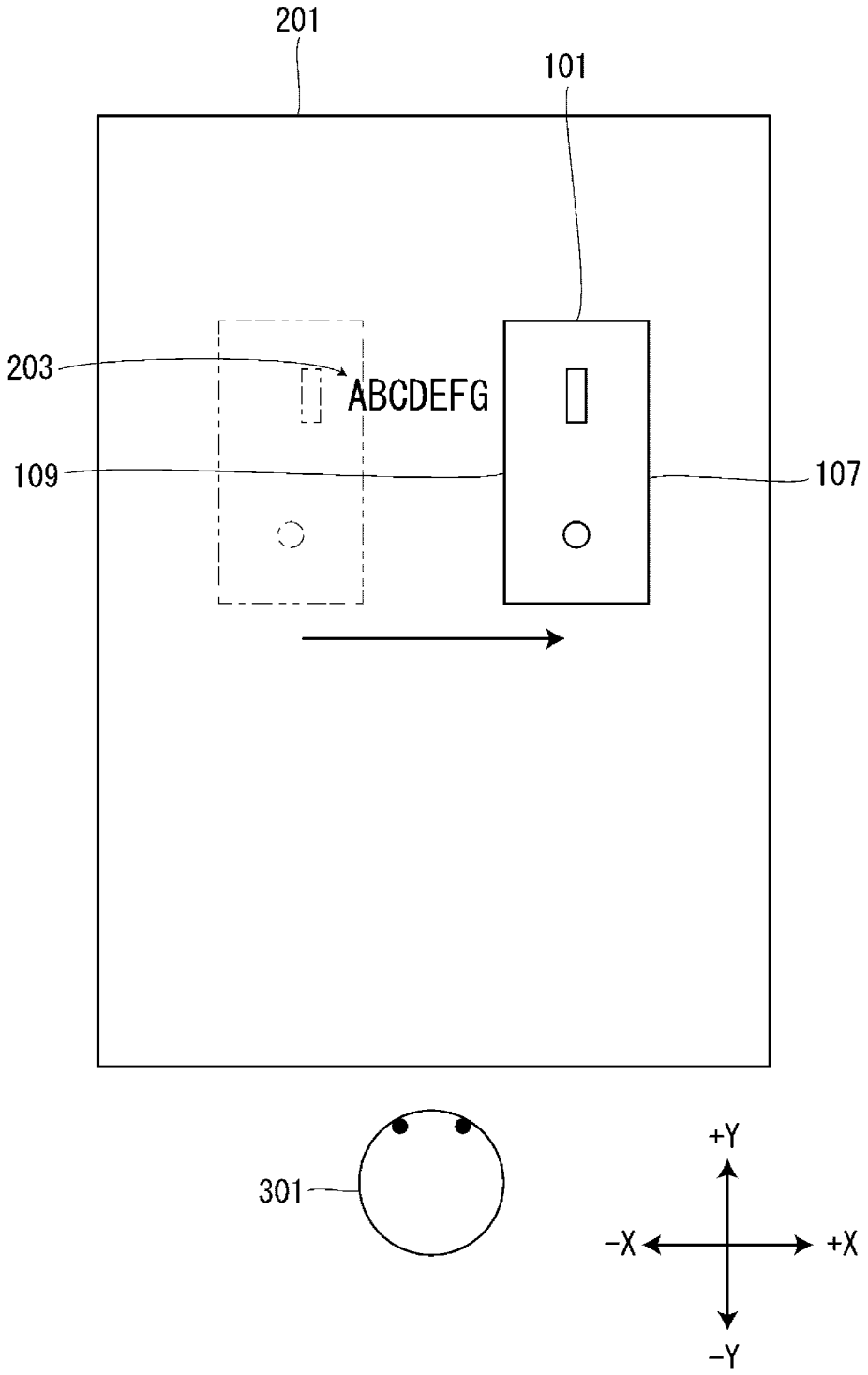
FIG. 4 shows a state where the printing device is moved in a +X-direction.

As shown in FIG. 4, the printing device 101 can print the print image 203 on the medium 201 while the printing device 101 is moved in the +X-direction as viewed from the printing device 101. Also, the printing device 101 can print the print image 203 on the medium 201 while the printing device 101 is moved in the −X-direction as viewed from the printing device 101. That the printing device 101 is moved in the +X-direction as viewed from the printing device 101 means that the printing device 101 is moved in such a way that the third outer surface 107 becomes the front face. That the printing device 101 is moved in the −X-direction as viewed from the printing device 101 means that the printing device 101 is moved in such a way that the fourth outer surface 109 becomes the front face.

When unable to execute a print job in one path, the printing device 101 can execute the print job divided into a plurality of paths. The path refers to a print operation carried out while the printing device 101 is moved in one direction of the +X-direction and the −X-direction.

When executing one print job divided into a plurality of paths in this way, the user 301 can select either one-direction print or two-direction print in terms of the direction of movement, via the information processing device 1. For example, when one-direction print is selected, the printing device 101 repeats an operation of printing in one path while moving in the +X-direction and subsequently moving in the −X-direction and the −Y-direction to start a new line. Meanwhile, when two-direction print is selected, the printing device 101 repeats an operation of printing in one path while moving in the +X-direction, subsequently moving in the −Y-direction to start a new line, then printing in the next path while moving in the −X-direction, and subsequently moving in the −Y-direction to start a new line.

A print job designates a direction of movement of the printing device 101 for each path. In the description below, a print job divided on a path basis is referred to as "path-based job". For example, in one-direction print, the designated direction is the +X-direction for all path-based jobs. In two-direction print, the designated direction is the +X-direction for path-based jobs of odd ordinal numbers and the designated direction is the −X-direction for path-based jobs of even ordinal numbers.

Print data included in a path-based job corresponds to the designated direction of movement of the printing device 101. For example, a path-based job in which the designated direction is the +X-direction includes print data such that a proper print image 203 is printed when the printing device 101 is moved in the +X-direction. A path-based job in which the designated direction is the −X-direction includes print data such that a proper print image 203 is printed when the printing device 101 is moved in the −X-direction.

The hardware configuration of the printing system SY will now be described with reference to FIG. 5. The printing system SY has the information processing device 1 and the printing device 101. The information processing device 1 has an operation/display unit 11, a processing device-side communication unit 13, and a processing device-side control unit 15.

The operation/display unit 11 is, for example, a touch panel and is used for various operations by the user 301 and to display various kinds of information. The operation/display unit 11 displays, for example, a print instruction screen 21 (see FIG. 6) and a print setting screen 31 (see FIG. 7).

Figure 6:
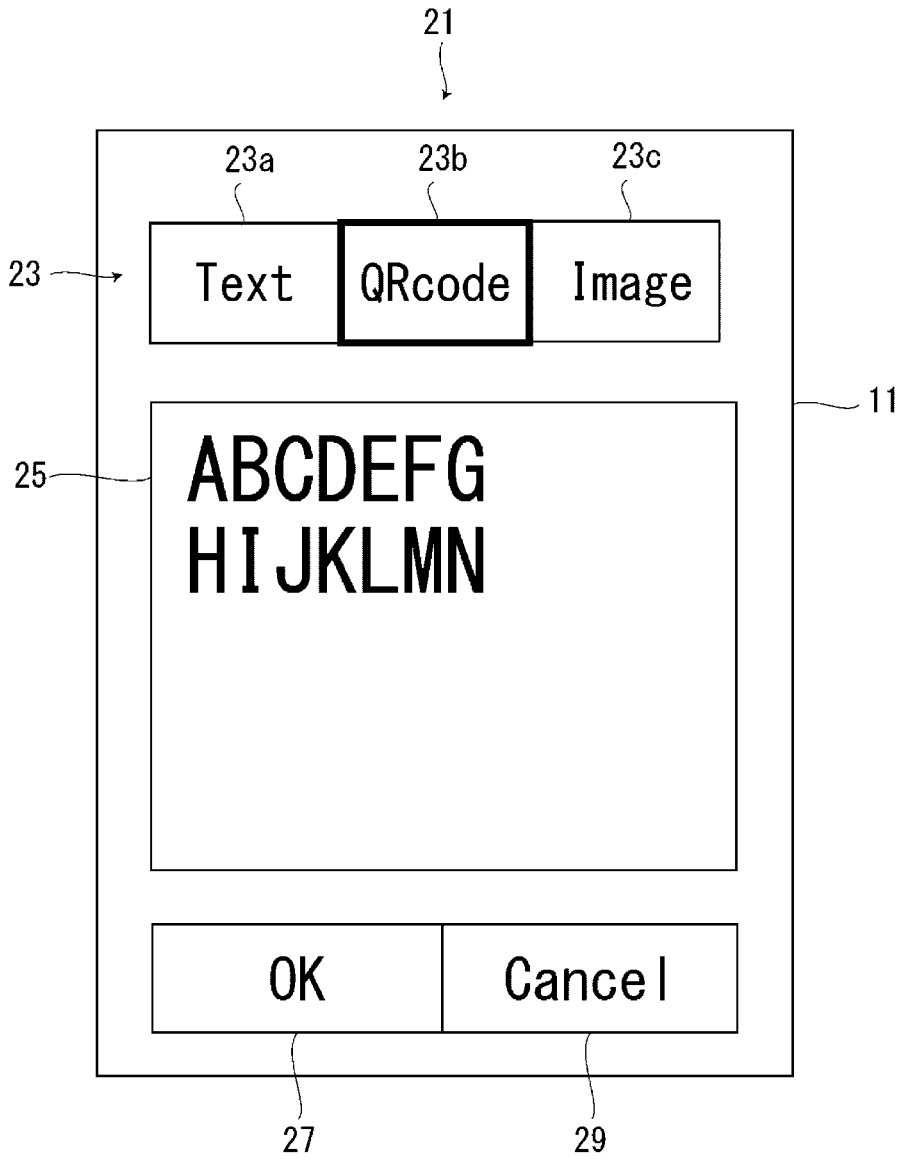
FIG. 6 shows a print instruction screen.

The print instruction screen 21 and the print setting screen 31 will now be described. As shown in FIG. 6, the print instruction screen 21 is provided with a print type selection section 23, an information input section 25, a first OK button 27, and a first cancel button 29.

In the print type selection section 23, a text option 23*a*, a QR code (trademark registered) option 23*b*, and an image option 23*c* are displayed in a selectable manner. When the text option 23*a* is selected in the print type selection section 23, a text is inputted to the information input section 25. The text refers to information provided with a text code, such as a letter, numeral, symbol or emoji inputted from a software keyboard, not illustrated. When the QR code option 23*b* is selected in the print type selection section 23, a text to be coded is inputted in the information input section 25. When the image option 23*c* is selected in the print type selection section 23, an image is drawn or inserted in the information input section 25. The image refers to information that is not provided with a text code.

In the information input section 25, a text inputted when the text option 23*a* or the QR code option 23*b* is selected in the print type selection section 23 is displayed. Also, in the information input section 25, an image drawn or inserted when the image option 23*c* is selected in the print type selection section 23 is displayed.

The first OK button 27 accepts an operation for confirming an input of information on the print instruction screen 21. When accepting an operation on the first OK button 27, the information processing device 1 confirms the input of information and displays the print setting screen 31. The first cancel button 29 accepts an operation for cancelling an input of information on the print instruction screen 21. When receiving an operation on the first cancel button 29, the information processing device 1 resets the information inputted on the print instruction screen 21 and causes the operation/display unit 11 to display an initial screen, not illustrated.

Figure 7:
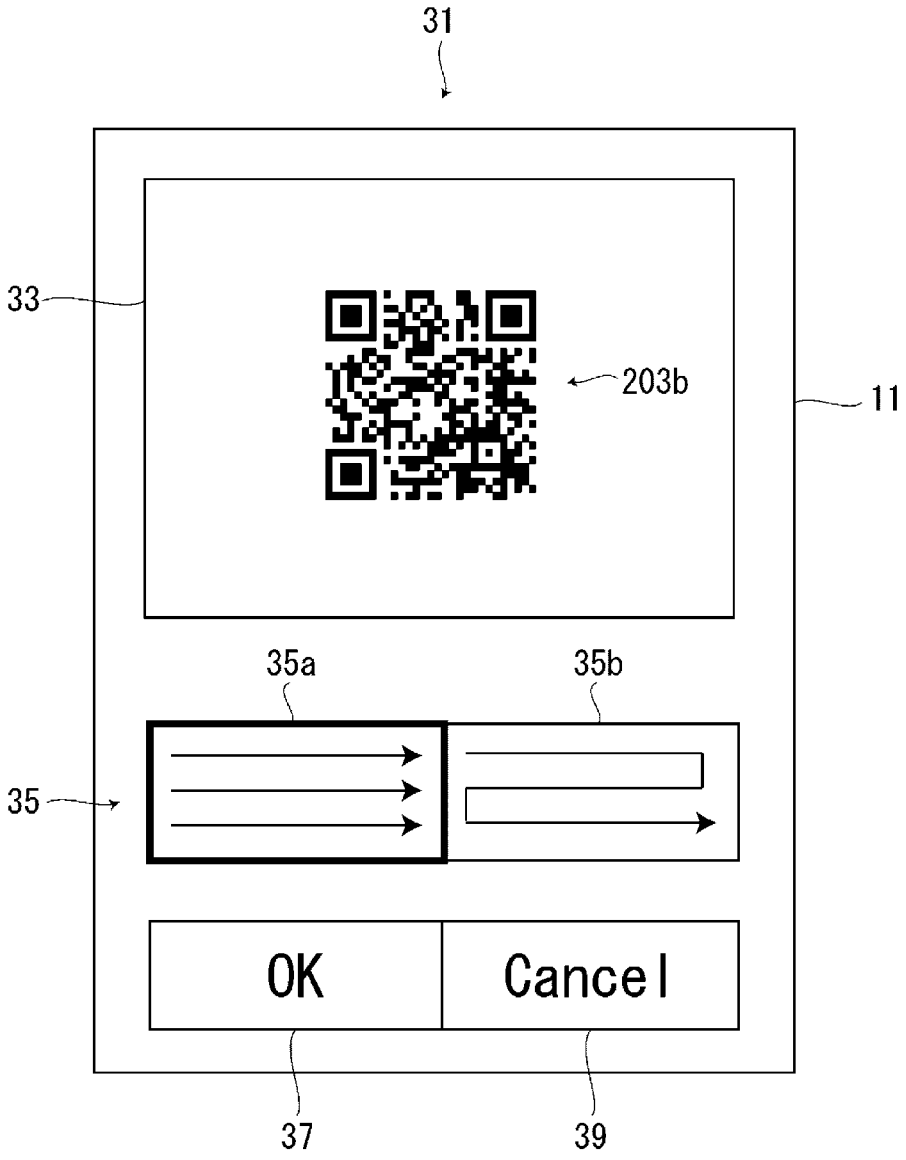
FIG. 7 shows a print setting screen.

As shown in FIG. 7, the print setting screen 31 is provided with a print preview 33, a movement direction selection section 35, a second OK button 37, and a second cancel button 39.

In the print preview 33, a preview of the print image 203 is displayed, based on information inputted to the information input section 25 of the print instruction screen 21. When the QR code option 23*b* is selected in the print type selection section 23 of the print instruction screen 21, as shown in FIG. 6, the information processing device 1 displays, as the print preview 33, a QR code image 203*b* formed by QRcoding the information inputted to the information input section 25 of the print instruction screen 21. The QR code image 203*b* is an example of a "specified print image" and a "code image".

In the movement direction selection section 35, a one-direction print option 35*a* and a two-direction print option 35*b* are displayed in a selectable manner. When printing of the print image 203 can be executed in one path, only the one-direction print option 35*a* may be made selectable and the two-direction print option 35*b* may be made unselectable.

The second OK button 37 accepts an operation for confirming a selection on the print setting screen 31. When accepting an operation on the second OK button 37, the information processing device 1 generates print data and transmits a print job including the generated print data, information representing a print type, and information representing a designated direction, to the printing device 101. The second cancel button 39 accepts an operation for cancelling a selection on the print setting screen 31. When accepting an operation on the second cancel button 39, the information processing device 1 resets the setting on the print setting screen 31 and causes the operation/display unit 11 to display the print instruction screen 21.

Figure 5:
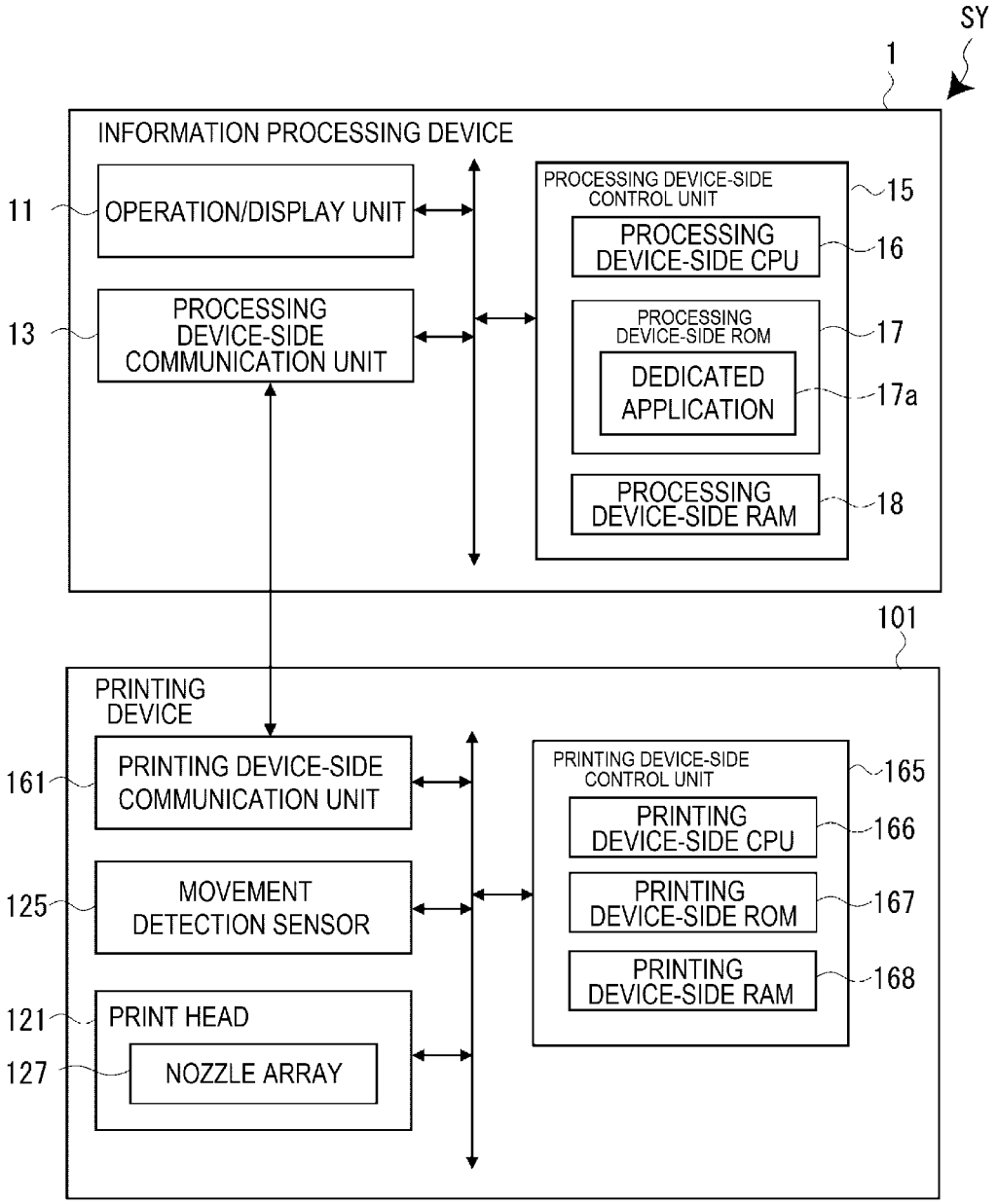
FIG. 5 is a control block diagram of the printing system.

Back to the explanation of FIG. 5, the processing device-side communication unit 13 communicates with the printing device 101 wirelessly or via other measures. For example, the processing device-side communication unit 13 transmits a print job to the printing device 101.

The processing device-side control unit 15 includes a processing device-side CPU (central processing unit) 16, a processing device-side ROM (read-only memory) 17, and a processing device-side RAM (random-access memory) 18.

The processing device-side CPU 16 loads various control programs stored in the processing device-side ROM 17 into the processing device-side RAM 18 and executes the control programs and thus performs various kinds of control. The processing device-side control unit 15 may use a hardware circuit such as an ASIC (application-specific integrated circuit), as a processor, instead of the processing device-side CPU 16. The processor may also be formed of one or more CPUs and a hardware circuit such as an ASIC cooperating with each other.

The processing device-side ROM 17 is a rewritable ROM such as a flash memory and stores various control programs and various control data. The processing device-side RAM 18 is used as a work area for the processing device-side CPU 16 to perform various kinds of control.

The processing device-side ROM 17 stores a dedicated application 17*a* for controlling the printing device 101. The processing device-side CPU 16 displays the print instruction screen 21 and the print setting screen 31, using the dedicated application 17*a*.

The processing device-side CPU 16 also generates a print job, using the dedicated application 17*a*. More specifically, the processing device-side CPU 16 generates a print job, based on the information inputted on the print instruction screen 21 and the setting on the print setting screen 31.

The printing device 101 has a printing device-side communication unit 161, the movement detection sensor 125, the print head 121, and a printing device-side control unit 165.

The printing device-side communication unit 161 communicates with the information processing device 1 wirelessly or via other measures.

The movement detection sensor 125 optically scans very small recesses and protrusions on the medium 201 while the printing device 101 is moved in relation to the medium 201, and thus outputs a movement detection signal for detecting the amount of movement, the direction of movement, and the speed of movement of the printing device 101.

The print head 121 has the nozzle array 127 including a plurality of nozzles that are arrayed. The print head 121 ejects ink from the plurality of nozzles and thus prints on the medium 201. The print head 121 may have a plurality of nozzle arrays 127. The printing device 101 may be provided with a plurality of print heads 121. In this case, the plurality of print heads 121 may be configured to eject ink of different colors from each other from the nozzles provided in each print head 121.

The printing device-side control unit 165 includes a printing device-side CPU 166, a printing device-side ROM 167, and a printing device-side RAM 168.

The printing device-side CPU 166 loads various control programs stored in the printing device-side ROM 167 into the printing device-side RAM 168 and executes the control programs and thus performs various kinds of control. The printing device-side control unit 165 may use a hardware circuit such as an ASIC (application-specific integrated circuit), as a processor, instead of the printing device-side CPU 166. The processor may also be formed of one or more CPUs and a hardware circuit such as an ASIC cooperating with each other.

The printing device-side ROM 167 stores various control programs and various control data. The printing device-side RAM 168 is used as a work area for the printing device-side CPU 166 to perform various kinds of control.

The printing device-side CPU 166 detects an amount of movement of the printing device 101 in the X-direction and the Y-direction, based on a movement detection signal outputted from the movement detection sensor 125. The printing device-side CPU 166 calculates a distance moved by the printing device 101 in the X-direction and the Y-direction, based on the detected amount of movement in the X-direction and the Y-direction, and detects the direction of movement of the printing device 101 and controls the print head 121, based on the calculated distance moved. More specifically, the printing device-side CPU 166 causes the print head 121 to eject ink from each nozzle at a timing based on the calculated distance moved. Thus, the printing device 101 can properly print the print image 203 on the medium 201, regardless of the speed at which the user 301 moves the printing device 101.

The printing device-side CPU 166 also detects a speed of movement of the printing device 101, based on the distance moved by the printing device 101 in the X-direction and the Y-direction per unit time. As described above, the printing device-side CPU 166 causes the print head 121 to eject ink from each nozzle at a timing based on the distance moved in the X-direction. However, when the ink ejection operation by the print head 121 does not catch up with the speed of movement, the print density of the print image 203 may drop. Therefore, when the speed of movement of the printing device 101 exceeds a threshold that is stored in advance in the printing device-side ROM 167, the printing device-side CPU 166 stops the print head 121 from printing. Thus, the printing device 101 is restrained from printing the print image 203 with the print density lowered due to an excessively high speed at which the printing device 101 is moved.

The threshold serving as a criterion to determine the print speed is a value decided according to the maximum ejection cycle of the print head 121 and the resolution of the print image 203. If the printing device 101 can change the resolution of the print image 203, the printing device 101 may change the threshold according to the resolution of the print image 203. If the information processing device 1 can designate the resolution of the print image 203, the printing device 101 may change the threshold according to the resolution designated by the information processing device 1.

Figure 8:
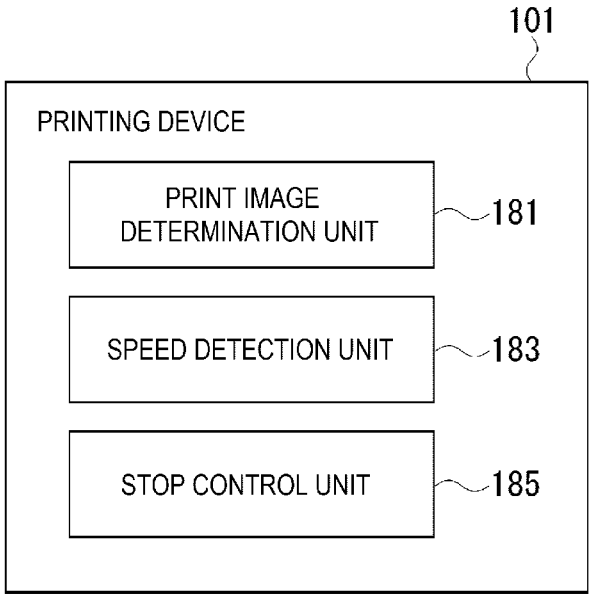
FIG. 8 is a functional block diagram of the printing device.

The functional configuration of the printing device 101 will now be described with reference to FIG. 8. The printing device 101 has a print image determination unit 181, a speed detection unit 183, and a stop control unit 185. Each of these functions is implemented by the printing device-side CPU 166 executing a control program stored in the printing device-side ROM 167. The stop control unit 185 is an example of a "control unit".

The print image determination unit 181 determines whether the print image 203 printed by the printing device 101 is the QR code image 203*b* or not. When information indicating a print type included in a print job transmitted from the information processing device 1 is information representing a QR code, the print image determination unit 181 determines that the print image 203 printed by the printing device 101 is the QR code image 203*b*.

The speed detection unit 183 detects a speed of movement at which the printing device 101 is moved, based on a movement detection signal outputted from the movement detection sensor 125.

The stop control unit 185 stops the print head 121 from printing when the speed of movement detected by the speed detection unit 183 exceeds the threshold. However, when the print image determination unit 181 determines that the print image 203 printed by the printing device 101 is the QR code image 203*b*, the stop control unit 185 stops the printing when the speed of movement exceeds the threshold. Meanwhile, when the print image determination unit 181 determines that the print image 203 printed by the printing device 101 is not the QR code image 203*b*, the determination about whether the speed of movement exceeds the threshold or not is not carried out. Consequently, the stop control unit 185 does not stop the printing even when the speed of movement exceeds the threshold.

Figure 9:
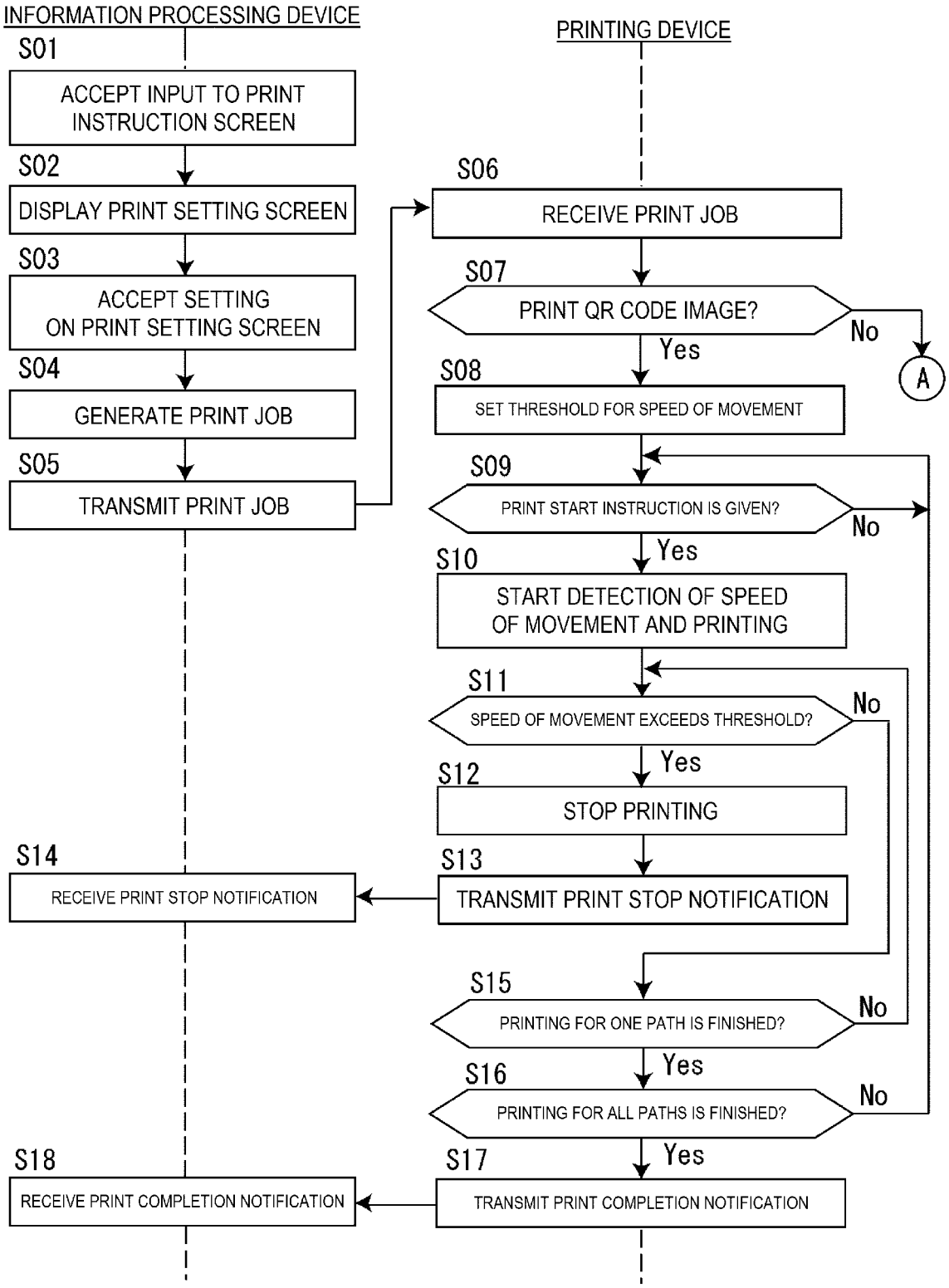
FIG. 9 is a flowchart showing printing control processing executed by an information processing device and printing processing executed by the printing device.

Printing control processing executed by the information processing device 1 and printing processing executed by the printing device 101 will now be described with reference to FIGS. 9 and 10. It is assumed that the information processing device 1 has started the dedicated application 17*a* and has displayed the print instruction screen 21 on the operation/display unit 11.

In step S01, the information processing device 1 accepts an input to the print instruction screen 21. The information processing device 1 accepts a selection of a print type and an input of information corresponding to the selected print type on the print instruction screen 21.

In step S02, the information processing device 1 displays the print setting screen 31 on the operation/display unit 11.

In step S03, the information processing device 1 accepts a setting on the print setting screen 31. The information processing device 1 accepts a selection of a direction of movement on the print setting screen 31.

In step S04, the information processing device 1 generates a print job, based on the information inputted to the print instruction screen 21 and the setting on the print setting screen 31.

In step S05, the information processing device 1 transmits the print job generated in step S04 to the printing device 101.

In step S06, the printing device 101 receives the print job transmitted from the information processing device 1.

In step S07, the printing device 101 determines whether the print image 203 to be printed is the QR code image 203*b* or not, based on the information representing the print type included in the print job. When determining that the print image 203 to be printed is the QR code image 203*b*, the printing device 101 proceeds to step S08. Meanwhile, when determining that the print image 203 to be printed is not the QR code image 203*b*, that is, that the print image 203 is the print image 203 of a text or image, the printing device 101 proceeds to step S21 in FIG. 10.

In step S08, the printing device 101 sets a threshold for the speed of movement. The printing device 101 sets a predetermined threshold as the threshold for the speed of movement.

In step S09, the printing device 101 determines whether a print start instruction is given or not. When a short press on the print button 115 is given, the printing device 101 determines that a print start instruction is given. When determining that a print start instruction is given, the printing device 101 proceeds to step S10. When determining that a print start instruction is not given, the printing device 101 repeats step S09.

In step S10, the printing device 101 starts detection of a speed of movement of the printing device 101, and printing. The printing device 101 detects the speed of movement of the printing device 101, based on the movement detection signal outputted from the movement detection sensor 125. The printing device 101 also performs drive control for a head driver, not illustrated, that drives the print head 121, and thus performs printing.

In step S11, the printing device 101 determines whether the speed of movement of the printing device 101 exceeds the threshold set in step S08 or not. When determining that the speed of movement of the printing device 101 exceeds the threshold, the printing device 101 proceeds to step S12. When determining that the speed of movement of the printing device 101 does not exceed the threshold, the printing device 101 proceeds to step S15.

In step S12, the printing device 101 stops printing. The printing device 101 stops driving the head driver, not illustrated, and thus stops printing.

In step S13, the printing device 101 transmits a print stop notification to the effect that the printing is stopped, to the information processing device 1.

In step S14, the information processing device 1 receives the print stop notification transmitted from the printing device 101.

In step S15, the printing device 101 determines whether printing for one path is finished or not. When determining that printing for one path is finished, the printing device 101 proceeds to step S16. When determining that printing for one path is not finished, the printing device 101 returns to step S11.

In step S16, the printing device 101 determines whether printing for all the paths is finished or not. When determining that printing for all the paths is finished, the printing device 101 proceeds to step S17. When determining that printing for all the path is not finished, the printing device 101 returns to step S09.

In step S17, the printing device 101 transmits a print completion notification to the effect that the printing is completed, to the information processing device 1.

In step S18, the information processing device 1 receives the print completion notification transmitted from the printing device 101.

Figure 10:
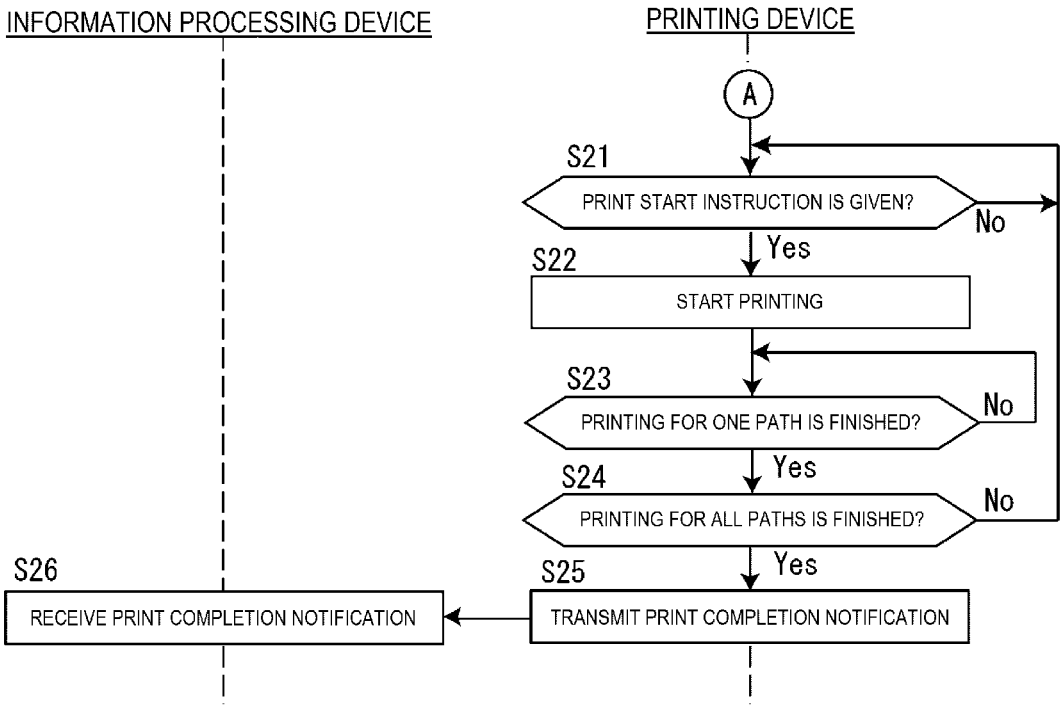
FIG. 10 is a flowchart continued from FIG. 9.

In step S21 in FIG. 10, the printing device 101 determines whether a print start instruction is given or not. When determining that a print start instruction is given, the printing device 101 proceeds to step S22. When determining that a print start instruction is not given, the printing device 101 repeats step S21.

In step S22, the printing device 101 starts printing.

In step S23, the printing device 101 determines whether printing for one path is finished or not. When determining that printing for one path is finished, the printing device 101 proceeds to step S24. When determining that printing for one path is not finished, the printing device 101 repeats step S23.

In step S24, the printing device 101 determines whether printing for all the paths is finished or not. When determining that printing for all the paths is finished, the printing device 101 proceeds to step S25. When determining that printing for all the path is not finished, the printing device 101 returns to step S21.

In step S25, the printing device 101 transmits a print completion notification to the effect that the printing is completed, to the information processing device 1.

In step S26, the information processing device 1 receives the print completion notification transmitted from the printing device 101.

As described above, the printing device 101 in this embodiment stops printing when the speed of movement at which the printing device 101 is moved exceeds a threshold. Therefore, printing of the print image 203 with the print density reduced due to the print operation that does not catch up with the speed of movement can be restrained.

The printing device 101 stops printing when the speed of movement exceeds the threshold, only in the case of printing the QR code image 203*b*. In the case of printing the print image 203 that is not the QR code image 203*b*, the printing device 101 does not determine whether the speed of movement exceeds the threshold or not, and consequently does not stop printing when the speed of movement exceeds the threshold. That is, the printing device 101 determines whether the speed of movement exceeds the threshold or not, only when printing the QR code image 203*b*, in which a drop in print density poses a problem. Otherwise, the printing device 101 does not determine whether the speed of movement exceeds the threshold or not. Thus, unnecessary processing can be omitted.

A low print density of the QR code image 203*b* may cause scanning failure. Therefore, in the case of printing the QR code image 203*b*, the printing device 101 stops printing when the speed of movement exceeds the threshold. Thus, the scanning failure of the QR code image 203*b* can be restrained.

The foregoing embodiment is not limiting. Modification examples described below can also be employed.

Modification Example 1

In the embodiment, in the case of printing the QR code image 203*b*, the printing device 101 stops printing when the speed of movement exceeds the threshold. However, the printing device 101 may notify an error at this time. For example, an LED (light-emitting diode) may be built in the print button 115, and the printing device 101 may turn on or turn on and off the LED built in the print button 115 to give an error notification.

In another modification example, the printing device 101 may notify an error via a sound or vibration.

Modification Example 2

Figure 11:
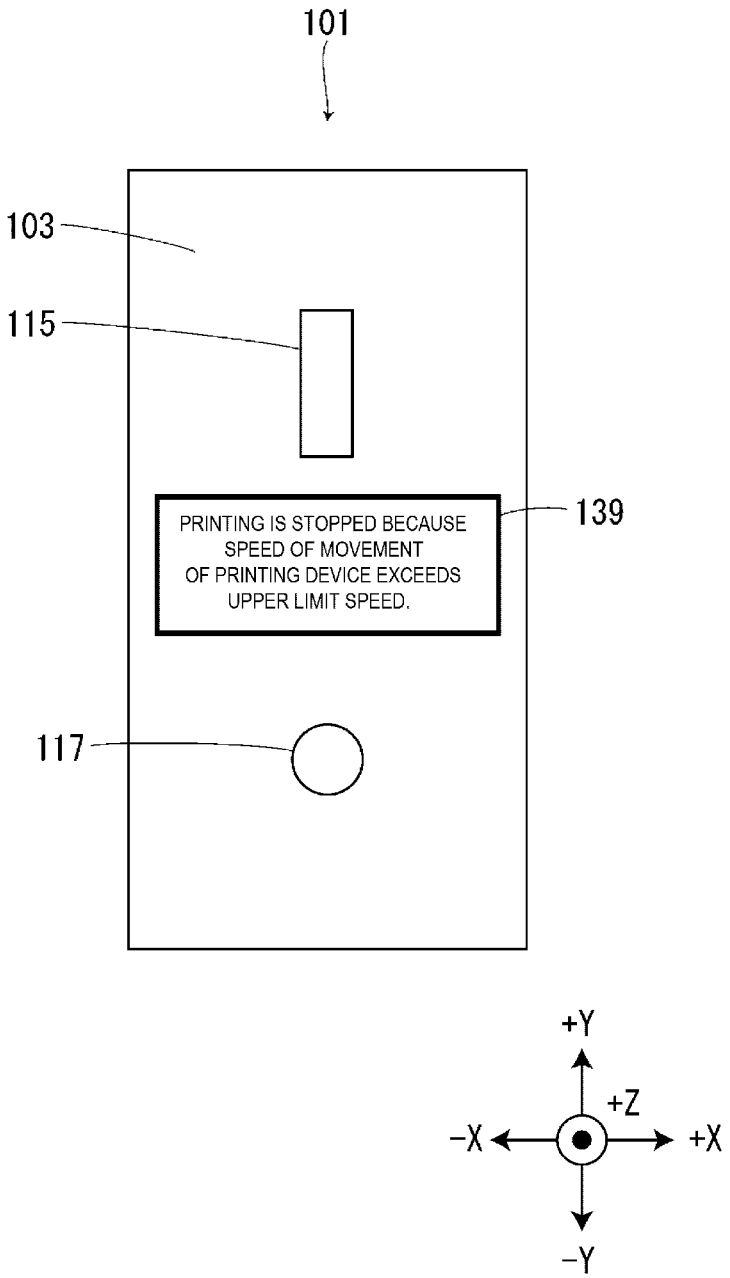
FIG. 11 shows a printing device having a display as viewed from a +Z-direction.

As shown in FIG. 11, the printing device 101 may notify an error, using a display 139. In this case, the printing device 101 may cause the display 139 to display a message to the effect that the printing is stopped because the speed of movement of the printing device 101 exceeds an upper limit speed.

In another modification example, the information processing device 1 may perform error notification. In this case, the printing device 101 may transmit error information to the information processing device 1 when the speed of movement exceeds the threshold in the case of printing the QR code image 203*b*. In response to this, the information processing device 1 may cause the operation/display unit 11 to display an error message to the effect that the printing is stopped because the speed of movement of the printing device 101 exceeds the upper limit speed, based on the error information received from the printing device 101.

Modification Example 3

The printing device 101 in the embodiment stops printing when the speed of movement exceeds the threshold in the case of printing the QR code image 203*b*. However, the printing device 101 may stop printing when the speed of movement exceeds the threshold, also in the case of printing a two-dimensional code image that is not the QR code image 203*b*. The printing device 101 may stop printing when the speed of movement exceeds the threshold, also in the case of printing a barcode image. The two-dimensional code image and the barcode image are an example of the "specified print image" and the "code image".

In another modification example, the printing device 101 may stop printing when the speed of movement exceeds the threshold, also in the case of printing the specified print image that is not a two-dimensional code or barcode. The specified print image may be, for example, the print image 203 of an image, or a color image or the like.

Modification Example 4

The printing device 101 in the embodiment determines whether to print the specified print image or not, based on the information representing the print type included in the print job transmitted from the information processing device 1. However, the printing device 101 may determine whether to print the specified print image or not, by performing image analysis of the print data included in the print job.

Modification Example 5

The printing device 101 may stop printing when the speed of movement exceeds the threshold, also in the case of printing the print image 203 that is not the specified print image. In this case, the printing device 101 may set different thresholds according to the print types of the print image 203 to be printed. For example, the printing device 101 sets a first threshold in the case of printing the print image 203 of a text. The printing device 101 sets a second threshold in the case of printing the QR code image 203*b*. The printing device 101 sets a third threshold in the case of printing the print image 203 of an image. As for the relationship between the three thresholds, the first threshold and the third threshold may be higher than the second threshold. The printing device 101 may also set the first threshold to be higher than the third threshold.

In another modification example, the printing device 101 may set a fourth threshold in the case of printing a barcode image. In this case, the printing device 101 may set the first threshold and the third threshold to be higher than the fourth threshold. The printing device 101 may also set the fourth threshold to be higher than the second threshold.

Modification Example 6

The printing device 101 may set different thresholds according to the sizes of the print image 203. For example, when a print job for printing the print image 203 of a first size is acquired, the printing device 101 may set a lower threshold than when a print job for printing the print image 203 of a second size that is larger than the first size is acquired.

In another modification example, the printing device 101 may acquire environment information such as temperature and humidity and set different thresholds according to the acquired environment information. In this case, the printing device 101 may have a sensor that measures environment information, and may acquire the result of detection by the sensor as environment information, or may acquire environment information from the information processing device 1.

Modification Example 7

The printing device 101 in the embodiment acquires a print job from the information processing device 1. However, the printing device 101 may acquire a print job from an external storage medium such as a flash memory.

In another modification example, the printing device 101 may generate a print job by itself. In this case, the printing device 101 may determine whether to print the specified print image or not, based on the generated print job.

Modification Example 8

The printing device 101 in the embodiment receives a print job including a plurality of path-based print jobs from the information processing device 1, when printing the print image 203 in a plurality of paths. However, the printing device 101 may receive path-based jobs one by one. In this case, the printing device 101 may request a path-based job for the next path to the information processing device 1, on accepting a print start instruction or on finishing printing a path.

Modification Example 9

The speed of movement of the printing device 101 may be detected, using not only an output signal from the movement detection sensor 125 but also an output signal from a gyro sensor detecting an angular velocity of the printing device 101.

Modification Example 10

The print head 121 is not limited to an inkjet head and may be, for example, a thermal head that prints in a thermal transfer method. The print head 121 may also eject other liquids than ink. For example, the print head 121 may eject a liquid such as an adhesive or coating agent.

In another modification example, the print head 121 may be configured to be attachable to and removable from the printing device 101, along with an ink cartridge containing a liquid. In this case, the printing device 101 may acquire type information of the print head 121 and set different threshold values for the speed of movement according to the acquired type information of the print head 121.

Modification Example 11

The information processing device 1 may be configured to be able to accept a selection of a code size or error correction level of the QR code image 203*b* on the print instruction screen 21, when the QR code option 23*b* is selected in the print type selection section 23 on the print instruction screen 21. In this case, the information processing device 1 may generate a print job for printing the QR code image 203*b*, based on the code size or error correction level of the accepted selection. Also, suitable changes can be made without departing from the spirit and scope of the present disclosure.

Supplementary Notes

Supplementary notes on the printing device and the control method for a printing device are given below.

A printing device 101 printing on a medium while being manually moved in relation to the medium is provided. The printing device 101 includes: a speed detection unit 183 detecting a speed of movement at which the printing device 101 is moved; and a stop control unit 185 stopping the printing when the speed of movement exceeds a threshold.

A control method for a printing device 101 printing on a medium while being manually moved in relation to the medium is provided. The control method executes: detecting a speed of movement at which the printing device 101 is moved; and stopping the printing when the speed of movement exceeds a threshold.

According to this configuration, the printing device 101 stops printing when the speed of movement exceeds the threshold. Therefore, printing of a print image with the print density reduced due to the print operation that does not catch up with the speed of movement at which the printing device 101 is moved can be restrained.

The printing device 101 may further include a print image determination unit 181 determining whether a print image printed by the printing device 101 is a specified print image or not. The stop control unit 185 may stop the printing when the speed of movement exceeds the threshold when the print image determination unit 181 determines that the print image is the specified print image. The stop control unit 185 may not stop the printing when the speed of movement exceeds the threshold when the print image determination unit 181 determines that the print image is not the specified print image.

According to this configuration, the printing device 101 does not stop printing when the speed of movement exceeds the threshold when the print image to be printed is not the specified print image. That is, the printing device 101 stops printing when the speed of movement exceeds the threshold, only in the case of printing the specified print image, in which a drop in print density poses a problem. Otherwise, the printing device 101 does not stop printing when the speed of movement exceeds the threshold. Therefore, unnecessary control can be omitted.

In the printing device 101, the specified print image may be a code image.

A low print density of the code image may cause scanning failure. According to this configuration, when the print image to be printed is a code image, the printing device 101 executes control of stopping printing when the speed of movement exceeds the threshold. Thus, the scanning failure of the code image can be restrained.

What is claimed is:

1. A printing device printing on a medium while being manually moved in relation to the medium, the printing device comprising:

a speed detection unit detecting a speed of movement at which the printing device is moved;

a control unit stopping the printing when the speed of movement exceeds a threshold; and a print image determination unit determining whether a print image printed by the printing device is a specified print image or not, wherein the control unit stops the printing when the speed of movement exceeds the threshold when the print image determination unit determines that the print image is the specified print image, and the control unit does not stop the printing when the speed of movement exceeds the threshold when the print image determination unit determines that the print image is not the specified print image.

2. The printing device according to claim 1, wherein the specified print image is a code image.

3. A control method for a printing device printing on a medium while being manually moved in relation to the medium, the control method executing:

detecting a speed of movement at which the printing device is moved;

stopping the printing when the speed of movement exceeds a threshold; and determining whether a print image printed by the printing device is a specified print image or not, wherein the printing stops when the speed of movement exceeds the threshold when it is determined that the print image is the specified print image, and the printing does not stop when the speed of movement exceeds the threshold when it is determined that the print image is not the specified print image.

* * * * *